United States Patent [19]

Geskin et al.

[11] Patent Number: 4,684,402

[45] Date of Patent: Aug. 4, 1987

[54] METHOD OF WASTE DISPOSAL, AND APPARATUS FOR THE SAME

[76] Inventors: Ernest S. Geskin, 21 Karen Pl., Edison, N.J. 08817; Joseph W. Bozzelli, 79 E. McClelland Ave., Livingston, N.J. 07039

[21] Appl. No.: 815,230

[22] Filed: Dec. 31, 1985

Related U.S. Application Data

[63] Continuation-in-part of Ser. No. 476,012, May 2, 1983.

[51] Int. Cl.[4] ..... C21C 7/00

[52] U.S. Cl. ..... 75/51.5; 75/32

[58] Field of Search ..... 75/51.5, 26, 32

[56] References Cited

U.S. PATENT DOCUMENTS 2,894,831 7/1959 Old ..... 75/26

3,264,096 8/1966 Agarwal ..... 75/26

4,422,872 12/1983 von Bogdandy ..... 75/51.5

*Primary Examiner*—Peter D. Rosenberg

*Attorney, Agent, or Firm*—Ilya Zborovsky

[57] ABSTRACT

A method of and an apparatus for heating, melting, waste disposal and production of gaseous fuel include supplying air, coal, steam and waste into a melt. The melt contains elements readily oxidized by air and producing oxides which are readily reduced by carbon. The overall results of the reaction of the elements oxidation and reduction consist in the production of CO containing gas and evolving heat. The heat evolved is extracted from the melt by submergence of solid to be heated into the melt, by injection of heated gases into the molten slag, by heat exchange between the wall confining the melt and gas, liquid or solid to be heated, or by conversion of steam into $H_2$ and CO.

9 Claims, 3 Drawing Figures

METHOD OF WASTE DISPOSAL, AND APPARATUS FOR THE SAME

This is a continuation-in-part of application Ser. No. 476,012, filed May 2, 1983.

BACKGROUND OF THE INVENTION

The present invention relates to a method of waste disposal.

Conventional methods of heating consist of fuel combustion and heat delivery to a material to be treated, by means of flame radiation and convection. Substantial disadvantages of the conventional methods are consumption of scarce kinds of fuel, nonuniformity of the temperature field and oxidizing atmosphere inside a furnace. Another conventional method is based upon the utilization of electrical energy. Disadvantages of these methods are a low overall energy efficiency and nonuniformity of the temperature field.

A fluidized bed reactor provides a means for coal combustion and for distribution of heat generation in the space of the reactor. However, this reactor can be used for heating only of fine, lumpy materials. Heat generated in the fluidized bed can be extracted only in a chamber separated from that of the combustion. The separation of the heat generation and extraction restricts application of such furnaces.

Uniform heating conditions and protective medium are acjieved by heating in a liquid bath. However, energy efficiency of these furnaces is low, and they use gaseous or oil fuel.

The most conventional way of gas heating consists in combustion. However, combustion changes the gas composition. in many cases, combustion is based on the utilization of scarse oil and gas fuel. Gas heating can also be carried out without changing the chemical composition by heat transfer between a heat source and a heated gas. Heat can be extracted from combustion products of high temperature wastes. Another conventional method of gas heating consists in a heat exchange between gases : one of these gases is a heat receiver, whereas the other of the gases is a heat source. Heat can be transferred through ceramic of metal walls separating the gas flows. This method is employed in boilers and recuperators. The drawback of such heating consists in the cost of material used for manufacturing gas exchangers and restrictions imposed on the temperature and pressure of a heated gas.

Another conventional method of gas heating consists in heat extraction from a heat source by a solid accumulator and heat transfer of this heat to a gas to be preheated. The implementation of this method by means of a periodical process is brough about in regenerators, caupers, stoves, and similar devices. Continuously this method is brought about in heat exchangers with moving elements (as disclosed for example, in R. Shchumann, 1952, p.p. 132–133). High thermal resistance of a solid restricts possible amount of heat accumulated. The temperature of gas heating is restricted and the cost of construction is relatively high.

The general shortcomings of conventional gas heating are their high cost, restricted temperature of preheating and impossibility to extract heat from all kinds of wastes, for example, from polluted gasses, from slag and so on.

Uniform heating conditions and utilization of chamical energy of carbon are achieved in steel-making converters and open hearth furnaces. However, the amount of heat available in these reactors is limited by the chamical energy of carbon disssolved in pig iron. this restricts application of this method.

The amount of energy available in a reactor similar to a converter can be increased by simultaneous injection of coal and air (oxygen) into a melt. One example of such reactors are given in the U.S. Pat. No. 3,711,275. However, the heat evolved in the reactors disclosed in this patent can be supplied pnly to a material absorbed in a bath. Sensible heat of flue gases and part of chemical energy of CO cannot be used in these reactors, and can be recovered only by means of air and material preheating. These drawbacks prevent effective utilization of the above mentioned method of material heating, and the described reactor cannot be used for gas heating.

One of the most promising sources of energy are different forms of the inductrial, agricultural and residential wastes. The inciniration of these wastes enables the utilization of their energy and at the same time the disposal of these wastes. Inciniration disposal in the final analysis is the only practical way of waste management. However, at present not all substances are completely destroyed in conventional inciniration sustems and there are condiderable siting difficulties, because of the known gaseous effluent and the adverse public opinion it creates. The present day incinirators to a great extent simply reproduce the design of conventional combusters, due to limited destruction experience and to operators familiarity with optimum fuel use. The requirements to a reactor for toxic waste disposal are, however, quite different from those applied to the today common usage of most efficient fuel combusters. Completeness of combustion and preparation of fuel have been optimized on present day incinirators for cost effectiveness and primization of overall operation, not destruction. The feasibility of the indiscriminate treatment of wastes as well as the total desctruction of toxic and offensive substances are on the contrary, the necessary condition for combustion of these species and not reactor operation for cost effective temperature and fuel use. The development of a system for indiscriminate waste inciniration with total destruction of hazardous and offensive substances is one of the conditions of the overall solution of waste problems.

SUMMARY OF THE INVENTION

Accordingly, it is an object of the present invention to provide a method of and an apparatus for waste disposal, which avoids the disadvantages of the prior art.

It is another object of this invention to provide a means for the disposal of wastes, including toxic wastes, and recovery of waste energy and utilization of solid residue in a new and advantageous manner.

It is also an object of the present invention to provide a method which can be accomplished in somewhat reconstructed, operating or abandoned conventional furnaces, for example on soaking pits or open hearth furnaces.

It is also an object of the invention to reduce hazardous impact of the furnaces atmosphere (surface oxidization, decarburization) on the furnace elements.

Still a further object of the invention is to replace refractory material in incinirators by molten slag or other inexpensive melt.

The principle object of the present invention is to develop a reliable method of utilization of chemical energy of coal and industrial, agricultural and residential wastes and the heat cintent of industrial wastes (flue gases, slad etc.) for heating of solid, liquid and gaseous material.

In keeping with these objects and with others which will become apparent hereinafter, one feature of the present invention resides in that coal, wastes, air, steam and flux agents are injected simultaneously into a melt. The melt contains metal readily oxidizable by air. Metal oxides are readily reduced by coal. CO gas and heat are evolved in this process.

The temperature of the melt is controlled by the rate of coal, wastes and air supply. The melt-gas emulsion volume is controlled by the pressure in the vessel and the rate of air supply. The melt flows around a heating chamber and through the chamber by means of channels similar to radiant tubes in conventional furnaces. Combustion products evolved in the melt and containing mostly $N_2$, CO and $H_2$ flow through the heating chamber, around the outside of the materials to be heated, through an air preheater, a boiler and eventually arrive into a gas holder. Heat extraction from the melt can be achieved by immersing a material to be heated into the emulsion. The process can include both heating by combustion products and immersion into emulsion. Heat extraction can be carried out by melt bubbling by emerging stream. Heat can also be extracted from the melt by flow of heated liquid or gaseous material through enclosures immersed into the melt.

The invention also includes an apparatus for implementing the above shortly described method. The novel features of the present invention will be defined in the appended claims. The invention itself, however, will be best understood from the following description which is accompanied by the following drawings.

DESCRIPTION OF PREFERRED EMBODIMENTS

Figure 1:
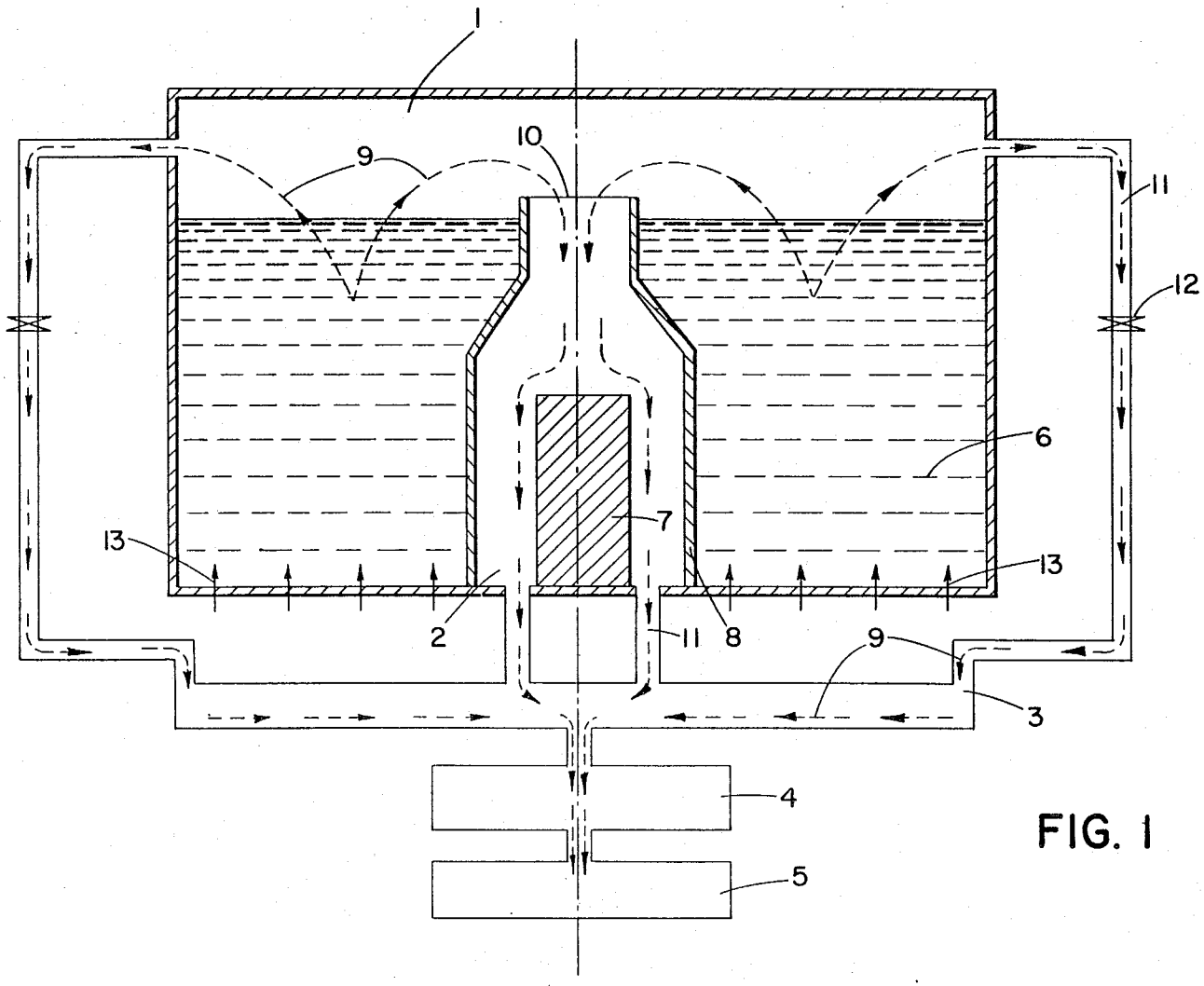
FIG. 1 is a schematic view of an apparatus in which a melt flows around a heating chamber and combustion products pass through the chamber, in accordance with the present invention.

An apparatus in accordance with the present invention is shown in FIG. 1 of the drawings and has a vessel 1 connected with a heating chamber 2 which accommodates a material to be treated. The chamber 2 is connected via a recuperator 3 and boiler 4 with a gas holder 5. The vessel 1 contains a melt 6 which is a heat producer, heat accumulator, heat carrier and gas producer. The material heated 7 is located in the chamber 2.

The vessel 1 and the chamber 2 are separated from one another by a partition 8. The partition 8 prevents the penetration of the melt into the chamber 2, whereas gases evolved in the vessel 1 can flow into the chamber through an opening 10. The vessel 1 as well as the chamber 2 are connected with the recuperator 3 by means of flues 11. Distribution of gases flowing to the recuperator 3 directly from the vessel 1 and through the chamber 2 is achieved by means of valves 12. From the recuperator 3, flue gases flow to the boiler 4. Steam produced by the boiler can be used for heating or generating electricity. If combustion products contain a significant amount of CO and $H_2$, they are collected in the gas holder 5. Air and steam are injected into the vessel through tuyeres 13 located under and above the melt surface. Air injected is previously preheated in the recuperator 3. the temperature of the air is controlled by the coal injection between the recuperator 3 and the vessel 1. Coal, wastes, and flux agents are supplied through the air tuyeres 13 or injected through special openings under and above the melt surface.

Air oxygen is absirbed by the melt and produces oxides of the melt elements. These oxides are reduced by coal or by treated wastes. Because of the high vessel temperature, CO gas is produced in this reaction. The temperature and the pressure at the vessel determine required composition of flue gases which contain mostly CO, $N_2$ and $H_2$. The melt in the vessel has the form of a gas-liquid emulsion. the volume of the emulsion is determined by the vessel pressure and rate of air injection. The level of the emulsion presents its inflow into the chamber 2. heat can be delivered to the vessel 1 also by means of flue gases and slag injected into the vessel.

The combustion products evolved in the vessel 1 can be evacuated by an exhauster. In this case, the pressure conditions in the vessel are similar to those in conventional heating furnaces, for example in an open hearth furnace. The high pressure in the vessel can be used to reduce the emulsion volume and to give rise to a flow of combustion products. In this case vessel 1 must be sealed. In the vessel 1 coal is converted into CO and $H_2$ and in a small portion into $CO_2$ and $H_2O$. The volatile components of coal. notably $H_2$, can be extracted by means of previous coal roasting and used as a fuel or raw material. Coal can be replaced by wastes, containing metals, C and H. Gas evolved at the vessel can be partially or totally burned in the vessel 1 or in the chamber 2 by injection of additional air. Excluding C and H, all components of wastes and coal are absrobed by the melt. Especially melt composition ensures absorption of sulphur, HCl and other environmentally hazardous components. The necessary composition of melt is obtained by use of flux agents. Rate of the air, coal, wastes and fluxes addition determines the required temperature and composition of the melt. The excessive amount of the melt is withdrawn from the vessel through special openings. The melt circulation is determined by the distribution of the tuyers for air and coal injection in the vessel 1 and the distribution of the air and coal between the tuyers.

The melt can be similar to those of a steel-making converter. The mass fraction of molten metal in melt may range from 0 to 80%. The most preferable is the melt containing a slag only. A steelmaking converter slag can be replaced by another material creating foam with gas and coal at the temperature of heat treatment, agressively absorbing oxygen, suphur, HCl and ash, and reacting with carbon particles.

Combustion products, mostly CO, $H_2$ and $N_2$ leave melt and enter the heating chamber 2 wherein they flow around the material to be heated. Heat to the chamber 2 is delivered from the vessel 1 through the partition 8 and by combustion products passing through the chamber. Heat also can be evolved by the partial or total combustion of CO and $H_2$, contained in the flue gases. To increase heat flow to the chamber 2 from the vessel 1, the chamber is immersed into the melt and air, and coal distribution determines the intensive melt circulation around the partition 8. The partition 8 must be made from a material which can resist corrosion at the melt temperature and has low thermal resistance. Because density of the emulsion is low, the mechanical strength of the partition is not significant. Refractory bricks, ceramic, asbestos or glass sheets, fabric and other materials can be used for partition construction.

Heat exchange between the melt 6 and the material 7 will be increased by the passage of the melt through the chamber 2 by means of hollow enclosure. The effect of the enclosure is similar to that of radiant tubes in conventional furnaces.

The process can be carried out in two interconnected vessels similarly to the process in two-hearth open hearth furnaces. This process contains two periods. During the first period the air is injected into the first vessel. Material to be heated in this vessel is immersed into the emulsion and CO is evolved. Combustion products from the first vessel are directed to the second vessels. There is no air injection in the second vessel, the melt level is low, the material heated is not covered by the melt, and heating is carried out by the combustion products evolved in the first vessel. After heating in the first vessel is completed, this vessel is discharged, and a new charge is loaded.

Figure 2:
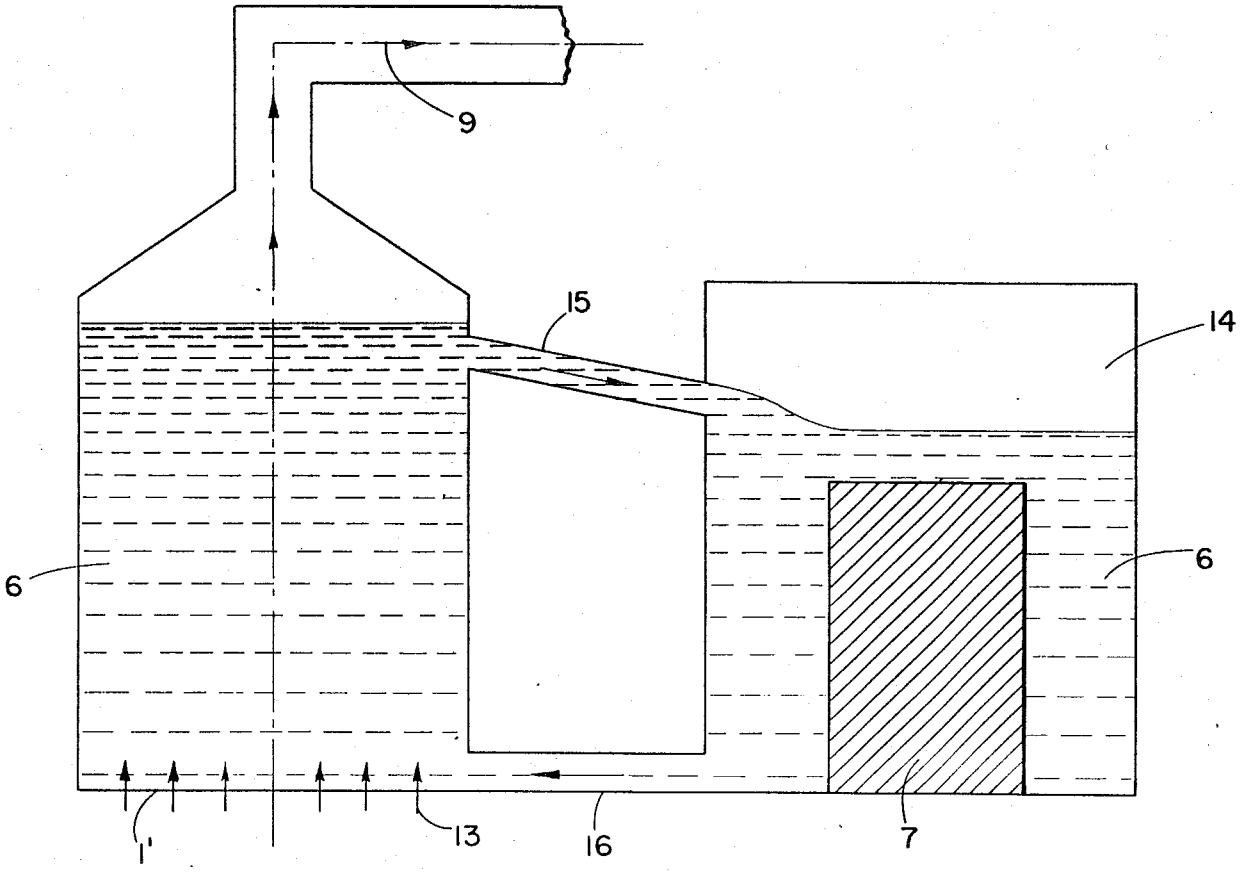
FIG. 2 is a schematic view of an apparatus in which a material to be heated is immersed in a separated vessel, in accordance with the present invention.

The material 7 can be immersed into a melt in a separate vessel 14 connected with a blasted vessel 1' by conduits 15 and 16, as shown in FIG. 2. The melt circulation through the conduits is caused by the difference in the levels and densities of the melt in these vessels. The process according to the invention can be used for heating as well as for melting. Because of the difference in the material densities, melt will be accumulated at the bottom of the vessel.

Figure 3:
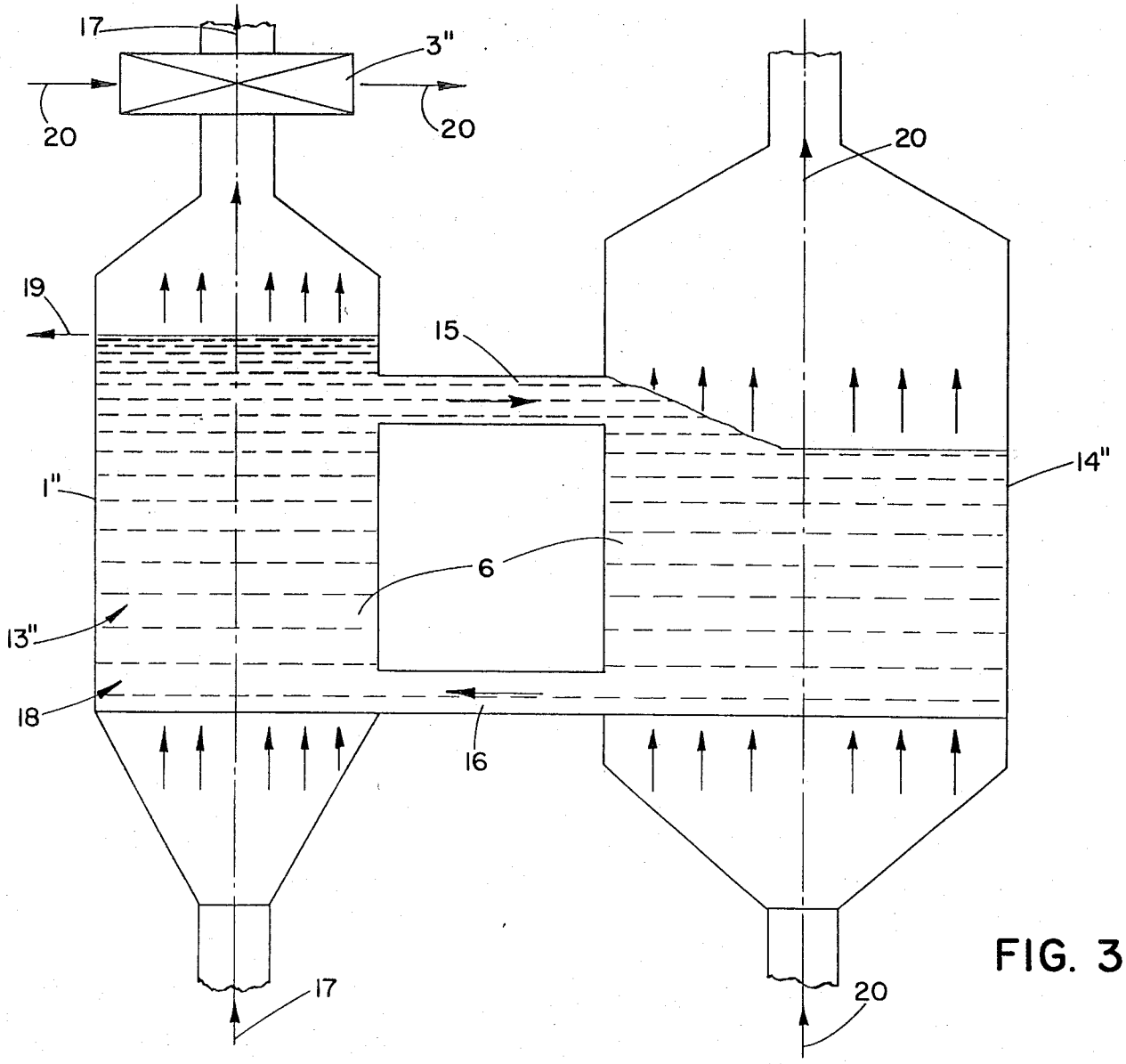
FIG. 3 is a schematic view of an apparatus for gas heating on which heat evolving in a melt and extracting from the melt are carried out in two separate vessels, in accordance with the present invention.

In accordance with the invention, there are provided also an apparatus for a method of gas heating which comprises a vessel 1'' and a vessel 14'', and a conventional gas preheater 3'' shown in FIG. 3. The melt 6 is deposited in the vessels 1'' and 14''. The melt contains elements readily oxidized by air and creating oxides readily reduced by carbon. Carbon, wastes and air are simultaneously injected into the melt through tuyers 13''. Heat is also delivered in the melt 6 by hot gases 17 which bubbles the melt layer and leaves vessels at the temperature approaching that of the melt. Gas 7 is a waste product of furnaces and other reactors. Heat contents of a leaving gas 17 is extracted in a conventional preheater 3'' or in a boiler. Heat is delivered also by a slag 18 rejected from a melting furnace. The slag 18 is supplied into the melt at the temperature of a melting furnace. The level of the melt in the vessel is sustained constant by withdrawing of extra melt through openings 19.

A heated gas 29 absorbs heat in the preheater 3'' and in the vessel 14''. After passage of the vessel 14'', the gas 20 is supplied to a consumer such as a furnace, turbine and the like. Passing the melt deposited in the vessel 14'', the gas achieved the temperature approaching that of the melt. The temperature of the gas 20 at the entrance of the vessel 14'' must be higher than the temperature of the melt solidification. The necessary temperature of air entering the vessel 14'' can be achieved by the coal injection in the air prior to the entering. The temperature of the heated gas can be controlled by bypassing the vessel 14'' by a part of the gas.

The melt 6 absorbs hest in the vessel 1'' and rejects it in the vessel 14''. The circulation of the melt between the vessel 1'' and 14'' occurs by means of the conduits 15 and 16. The melt from the vessel 1'' flows to the vessel 14'' through the conduit 15 because the level of the conduit is higher than the melt level in the vessel 14''. The size of the vessel and condition of air and coal injection insure low amount of coal in a melt entering the conduit 15. The melt from the vessel 14'' flows to the vessel 1'' because of the difference in the melt densitis of both vessels. The necessary densities and levels of gas-liquid emulsion in both vessels are achieved by the control of the gas flows entering these vessels. These levels are also controlled by the static pressure in both vessels. The pressure is kept in the range insuring the necessary volume of the emulsion and required pressure in a gas receiver.

Heat evolving and absorbing can be carried out in the same vessel by periodical supply of a hot gas to a gas consumer; a heating system must be equipped with several periodical preheaters. The pressure in liquid bath can be readily controlled and maintained at the level required by a gas consumer. Pressure in a heat consumer can be different from the pressure in a heat source. For example, the pressure in a furnace flue which is a source, might be different from the pressure in a turbine inlet. In this case, the pressure in the vessel must be sustained at two different levels during heat supply to the melt and heat extraction from the melt.

The pressure in the vessels can be maintained at the level of 1–20 atm. This ensures the ptimal size of an emulsion and consequently the optimal size of the vessels. The heated gas can be separated from the means of an enclosure immersed into the melt. The pressure inside and outside of the enclosures are approximately equal to one another. This enables us to use ceramics, refractory fabrics and other nonexpensive materials for gas heating to high temperature at high pressure.

The melt 6 can be formed from nonexpensive readily available material having melting point lower than the temperature of gas preheating. For example, the molten pig iron or molten steelmaking slag can be used for gas preheating up to temperature 1300°–1600° C. These melts also can be used for extracting chemical energy of coal or wastes.

Heat accumulated in the melt 6 can be used for coal conversion and waste pyrolysis. The vessel 1 can be blasted periodically by air and water. Air blasting is carried out into melt to insure total buring of CO in the vessel. The heat collected in the vessel will be consumed for the conversion of $H_2O$ injected after air. The gases obtained from the coal conversion will be accumulated in the special gas holder which is connected with the vessel 1 obly during steam injection. The heat loses in the vessels and other parts of the apparatus are reduced by use of vaporizing cooling system.

EXAMPLE

The invented apparatus can be used for the implementation of waste disposal and decontamination of toxic wastes. A waste to be disposed and air are simultaneously added into a molten metal-slag bath. High temperature of the bath insures the pyrolysis of organic substances. The composition of the bath insures absorption of non-organic materials. The gases evolved in the bath leave the melt and after cooling are accumulated in a gas holder and used as a fuel. The sensible heat of gases, extracted during cooling, is used for steam generation and preheating of air. The viscosity of the slag determines the residence time of the gas bubble in the melt. This time exceeds the time required for the destruction of hazardous gaseous substance. If the temperature of off-gas is not sufficient for the decontamination of off-gases, the temperature of gases can be increased by the injection of oxygen or electric energy inthe gas flow. In this way the temperature of off-gas can be increased up to 2000° C.

Another way to ensure the complete decontamination of off-gases is to bubble this gas through the heat exchanger 13 (FIG. 3) which brings about additional exposure of hazardous substances to high temperature. To remove hazardous substances such as HCl or sulphur oxides, off-gas can pass through a chemically reactive solid layer, for example the layer of lime.

Carboneous residue of wastes will react with oxides particularly with FeO, evolving CO and Fe. This combustion of carboneous residue provides energy required for process performance. Additional energy for the process can be obtained by the additional coal supply. The non-organic substances of the waste can be removed from the slag by the use of known extractive metallurgy methods. The slag is continuously withdrawn from the bath and used to produce valuable products for example construction materials.

The invention is not limited to the details shown since various modifications and structural changes are possible without departing in any way from the spirit of the invention.

What is desired to be protected by Letters Patent is set forth in particular in the appended claims.

We claim:

1. A method of waste disposal comprising the steps of providing a vessel having at least two chambers;

depositing a melt in at least one of said chambers, the melt being selected from the group consisting of a metal, metal oxides and nonmetal oxides;

adding waste, air, oxygen, steam, fluxes, hot flue gases and slag into the melt;

maintaining the melt temperature and composition so as to ensure an absorption of oxygen and to thereby produce oxides, and reduction of the oxides produced during the absorption, by the added waste, and so as to ensure complete destruction of hazardous and offensive elements of the added waste;

generating gaseous, liquid amd solid products by waste pyrolysis and reaction between the waste and the melt;

continuously withdrawing the gaseous products as off-gases from the melt; and retaining the liquid and solid products in the melt.

2. A method as defined in claim 1; and further including the step of partial combustion of off-gases to ensure total decontamination of the off-gases.

3. A method as defined in claim 1; and further including the step of electrical heating of off-gases to ensure total decontamination of the off-gases.

4. A method as defined in claim 1; and further including the step of passing off-gases through an additional molten bed to ensure complete removal of hazardous and offensive substances from the off-gases.

5. A method as defined in claim 1; and further comorising the step of passing off-gases through an additional solid bed to ensure complete removal of hazardous or offensive substances from these gases.

6. A method as defined in claim 1; and further comprising the steps of creating bath circulation in such a manner which enables adding non-treated waste directly from delivery trucks or pipes on a melt surface.

7. A method as defined in claim 1; and furher comprising the step of withdrawing the slag from the vessel and utilizing the same as a construction material.

8. A method as defined in claim 1, wherein said providing step includes arranging said chambers so that one of said chamber is an outer chamber while the other of said chambers is an inner chamber, and said inner and outer chambers are separated from one another by a refractory wall, said depositing step including depositing said melt into said outer chamber.

9. A method as defined in claim 1, wherein said providing step includes arranging said chambers side-by-side at a distance from one another and communicating said chambers with one another by a communicating passage, said depositing step including depositing said melt into one of said chambers arranged side-by-side.

* * * * *